US010458229B2

(12) United States Patent
Roberson et al.

(10) Patent No.: US 10,458,229 B2
(45) Date of Patent: Oct. 29, 2019

(54) DOWNHOLE COMMUNICATIONS USING VARIABLE LENGTH DATA PACKETS

(71) Applicant: Halliburton Energy Services, Inc., Houston, TX (US)

(72) Inventors: Mark W. Roberson, Cary, NC (US); Krishna M. Ravi, Kingwood, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 38 days.

(21) Appl. No.: 15/535,343

(22) PCT Filed: Mar. 11, 2015

(86) PCT No.: PCT/US2015/019853
§ 371 (c)(1),
(2) Date: Jun. 12, 2017

(87) PCT Pub. No.: WO2016/144344
PCT Pub. Date: Sep. 15, 2016

(65) Prior Publication Data
US 2017/0350239 A1 Dec. 7, 2017

(51) Int. Cl.
*E21B 47/12* (2012.01)
*E21B 49/08* (2006.01)

(52) U.S. Cl.
CPC ..... *E21B 47/122* (2013.01); *E21B 47/12* (2013.01); *E21B 49/08* (2013.01)

(58) Field of Classification Search
None
See application file for complete search history.

(56) References Cited

U.S. PATENT DOCUMENTS

| | | | | |
|---|---|---|---|---|
| 4,390,975 | A | 6/1983 | Shawhan | |
| 5,148,408 | A | 9/1992 | Matthews | |
| 2002/0149498 | A1* | 10/2002 | Tabanou | E21B 7/061 340/854.5 |
| 2008/0031139 | A1* | 2/2008 | Muro | H04W 28/08 370/237 |
| 2009/0081971 | A1 | 3/2009 | Rofougaran et al. | |
| 2009/0110107 | A1* | 4/2009 | Abdallah | E21B 47/122 375/295 |
| 2010/0177596 | A1 | 7/2010 | Fink et al. | |
| 2012/0013893 | A1 | 1/2012 | Maida et al. | |
| 2014/0246237 | A1 | 9/2014 | Prammer | |
| 2018/0135408 | A1* | 5/2018 | Cooley | E21B 41/0085 |

FOREIGN PATENT DOCUMENTS

| | | |
|---|---|---|
| WO | 2011019351 | 2/2011 |
| WO | 2014100272 | 6/2014 |

OTHER PUBLICATIONS

International Patent Application No. PCT/US2015/019853 , "International Search Report and Written Opinion", dated Oct. 14, 2015, 13 pages.

* cited by examiner

*Primary Examiner* — Firmin Backer
*Assistant Examiner* — Jerold B Murphy
(74) *Attorney, Agent, or Firm* — Kilpatrick Townsend & Stockton LLP

(57) ABSTRACT

A system that is positionable in a wellbore can include a transceiver that is positionable external to a casing string and programmable to vary a number of data packets that are wirelessly transmitted by the transceiver. The number of data packets can correspond to an amount of data wirelessly transmitted by the transceiver about an environment in the wellbore.

22 Claims, 6 Drawing Sheets

DOWNHOLE COMMUNICATIONS USING VARIABLE LENGTH DATA PACKETS

CROSS-REFERENCE TO RELATED APPLICATIONS

This is a U.S. national phase under 35 U.S.C. 371 of International Patent Application No. PCT/2015/019853 titled "Downhole Communications Using Variable Length Data Packets" and filed Mar. 11, 2015, the entirety of which is incorporated herein by reference.

TECHNICAL FIELD

The present disclosure relates generally to devices for use in well systems. More specifically, but not by way of limitation, this disclosure relates to downhole communications using variable length data packets.

BACKGROUND

A well system (e.g., an oil or gas well) can include a wellbore that is typically drilled for extracting hydrocarbons from a subterranean formation. Various sensors can be positioned in the wellbore for detecting well system characteristics, such as temperature, pressure, sound level, the presence of a fluid, or the physical state (e.g., solid, liquid, or gas) of a substance (e.g., cement) in the wellbore. In some examples, the sensors can transmit data to a well operator (e.g., at the well surface). The well operator can rely on the data to determine if the well system is safe, compliant with particular standards, contains anomalies, or has other characteristics of interest.

DETAILED DESCRIPTION

Figure 1:
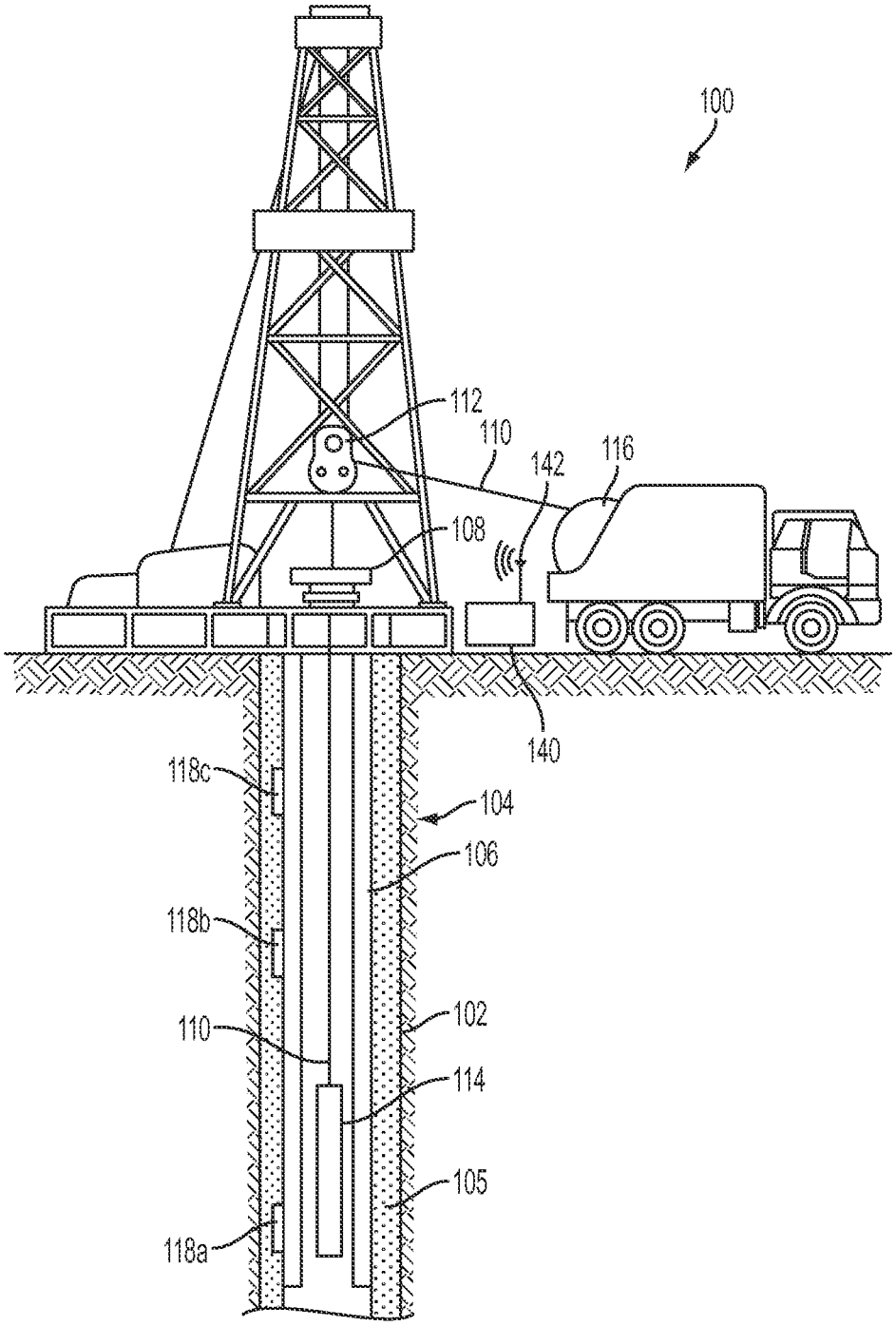
FIG. 1 is a cross-sectional view of an example of a well system that includes a system for downhole communications using variable length data packets.

Certain aspects and features of the present disclosure are directed to downhole communications using variable length data packets. The downhole communications can be wireless communications between a transceiver positioned external to a casing string in a wellbore and a receiver (e.g., another transceiver or a computing device positioned in the well system). A transceiver can be positioned external to the casing string if it is positioned on or external to an outer diameter or outer wall of the casing string. The transceiver can be programmed to vary a number of data packets that it transmits to the receiver. The number of data packets can correspond to an amount of data to be wirelessly transmitted by the transceiver. In some examples, the data can be about an environment in the wellbore. The data can include temperature, pressure, and a sound level within the wellbore; the presence or absence of a particular fluid (e.g., mud, a hydrocarbon, spacer fluid, or cement) at a particular location in the wellbore; a type of a fluid in the wellbore (e.g., whether the fluid includes a hydrocarbon, mud, cement, water, spacer fluid, or any combination of these); and a physical state (e.g., solid, liquid, or gas) of a substance (e.g., cement) in the wellbore.

In some examples, the transceiver can be remotely programmed to transmit a particular number of data packets (e.g., a particular amount of data) subsequent to being positioned in the wellbore. For example, a computing device (e.g., at the well surface) can wirelessly transmit a control signal to the transceiver. The transceiver can select a data transmission mode from among multiple available data transmission modes based on the control signal. The data transmission mode can configure the transceiver to send a particular amount of data or number of data packets. Examples of the available data transmission modes can include a low data transmission mode, a medium data transmission mode, and a high data transmission mode. The low data transmission mode can cause the transceiver to transmit a small amount of data (e.g., a small number of data packets), the medium data transmission mode can cause the transceiver to transmit more data than the low data mode (e.g., a larger number of data packets), and the high data transmission mode can cause the transceiver to transmit more data than the medium data transmission mode (e.g., a still larger number of data packets).

In some examples, the transceiver can be programmed to transmit a particular number of data packets prior to being positioned in the wellbore. For example, the transceiver can be programmed during manufacturing or distribution (e.g., while in a manufacturer's factory), at a well site, or while in transit to the well site. The transceiver can be programmed before, during, or after various well operations, such as during pumping operations. The transceiver can be programmed to transmit data using a particular data transmission mode, which can be selected from among the multiple available data transmission modes. For example, the transceiver can be programmed to transmit data using the high data transmission mode.

In some examples, the transceiver can include or be electrically coupled to electronic devices including sensors. The transceiver can activate or deactivate (e.g., operate) some or all of the electronic devices based on the selected data transmission mode. For example, the transceiver can include a temperature sensor, a fluid analyzer, and a Radio Frequency Identification (RFID) reader. If the transceiver is in the low data transmission mode, the transceiver can deactivate the RFID reader and the fluid analyzer. The transceiver can acquire data from the temperature sensor and transmit the data to the well operator. By acquiring data from a subset of the available sensors, rather than from all of the available sensors, the transceiver can save battery power. Also, by transmitting data from fewer than all of the available sensors (e.g., the data from only the temperature sensor) to the well operator, rather than the cumulative data from all of the available sensors, the transceiver can use less battery power. This may extend the lifespan of the transceiver.

As another example, if the transceiver is in a medium data transmission mode, the transceiver can acquire data from the temperature sensor and the fluid analyzer, and transmit the data to the well operator. In this example, the transceiver can use more power than when in the low data mode, but can also transmit more data (e.g., data from both the temperature sensor and the fluid analyzer) or a higher number of data packets than when in the low data transmission mode.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 is a cross-sectional view of an example of a well system 100 that includes a system for downhole communications using variable length data packets. The well system 100 includes a wellbore 102 extending through various earth strata. The wellbore 102 extends through a hydrocarbon bearing subterranean formation 104. A casing string 106 extends from the surface 108 to the subterranean formation 104. The casing string 106 can provide a conduit through which formation fluids, such as production fluids produced from the subterranean formation 104, can travel from the wellbore 102 to the surface 108. The casing string 106 can be coupled to the walls of the wellbore 102 via cement. For example, a cement sheath 105 can be positioned (e.g., formed) between the casing string 106 and the walls of the wellbore 102 for coupling the casing string 106 to the wellbore 102.

The well system 100 can also include at least one well tool 114 (e.g., a formation-testing tool). The well tool 114 can be coupled to a wireline 110, slickline, or coiled tube that can be deployed into the wellbore 102. The wireline 110, slickline, or coiled tube can be guided into the wellbore 102 using, for example, a guide 112 or winch. In some examples, the wireline 110, slickline, or coiled tube can be wound around a reel 116.

The well system 100 can include a computing device 140. The computing device 140 can be positioned at the surface 108, below ground, or offsite. The computing device 140 can include a processor interfaced with other hardware via a bus. A memory, which can include any suitable tangible (and non-transitory) computer-readable medium, such as RAM, ROM, EEPROM, or the like, can embody program components that configure operation of the computing device 140. In some aspects, the computing device 140 can include input/output interface components (e.g., a display, keyboard, touch-sensitive surface, and mouse) and additional storage.

The computing device 140 can include a communication device 142. The communication device 142 can represent one or more of any components that facilitate a network connection. In the example shown in FIG. 1, the communication device 142 is wireless and can include wireless interfaces such as IEEE 802.11, Bluetooth, or radio interfaces for accessing cellular telephone networks (e.g., transceiver/antenna for accessing a CDMA, GSM, UMTS, or other mobile communications network). In some examples, the communication device 142 can use acoustic waves, mud pulses, surface waves, vibrations, optical waves, or induction (e.g., magnetic induction) for engaging in wireless communications. In other examples, the communication device 142 can be wired and can include interfaces such as Ethernet, USB, IEEE 1394, or a fiber optic interface.

The well system 100 can also include transceivers 118*a-c*. In some examples, each of the transceivers 118*a-c* can be positioned on, partially embedded within, or fully embedded within the casing string 106, the cement sheath 105, or both. In some examples, the transceivers 118*a-c* can be positioned externally to the casing string 106. For example, the transceivers 118*a-c* can be positioned on an outer housing of the casing string 106, within the cement sheath 105, or within the subterranean formation 104. Positioning the transceivers 118*a-c* externally to the casing string 106 can be advantageous over positioning the transceivers 118*a-c* elsewhere in the well system 100, such as within the casing string 106, which can affect a drift diameter of the casing string 106. Additionally, positioning the transceivers 118*a-c* externally to the casing string 106 can allow the transceivers 118*a-c* to more accurately and efficiently detect characteristics of the subterranean formation 104, the cement sheath 105, and the casing string 106.

The transceivers 118*a-c* can wirelessly communicate with one another and the computing device 140. Each of the transceivers 118*a-c* can include a communications device (e.g., described in further detail with respect to FIG. 5). The communications device can be substantially similar to the communication device 142 associated with the computing device 140.

In some examples, the transceivers 118*a-c* can wirelessly communicate data in segments or "hops" to a destination (e.g., uphole or downhole). For example, a transceiver 118*a* can transmit data to another transceiver 118*b* (e.g., positioned farther uphole), which can relay the data to still another transceiver 118*c* (e.g., positioned even farther uphole), and so on. As another example, one transceiver 118*b* can transmit data to another transceiver 118*c*, which can relay the data to a destination (e.g., the computing device 140).

Figure 2:
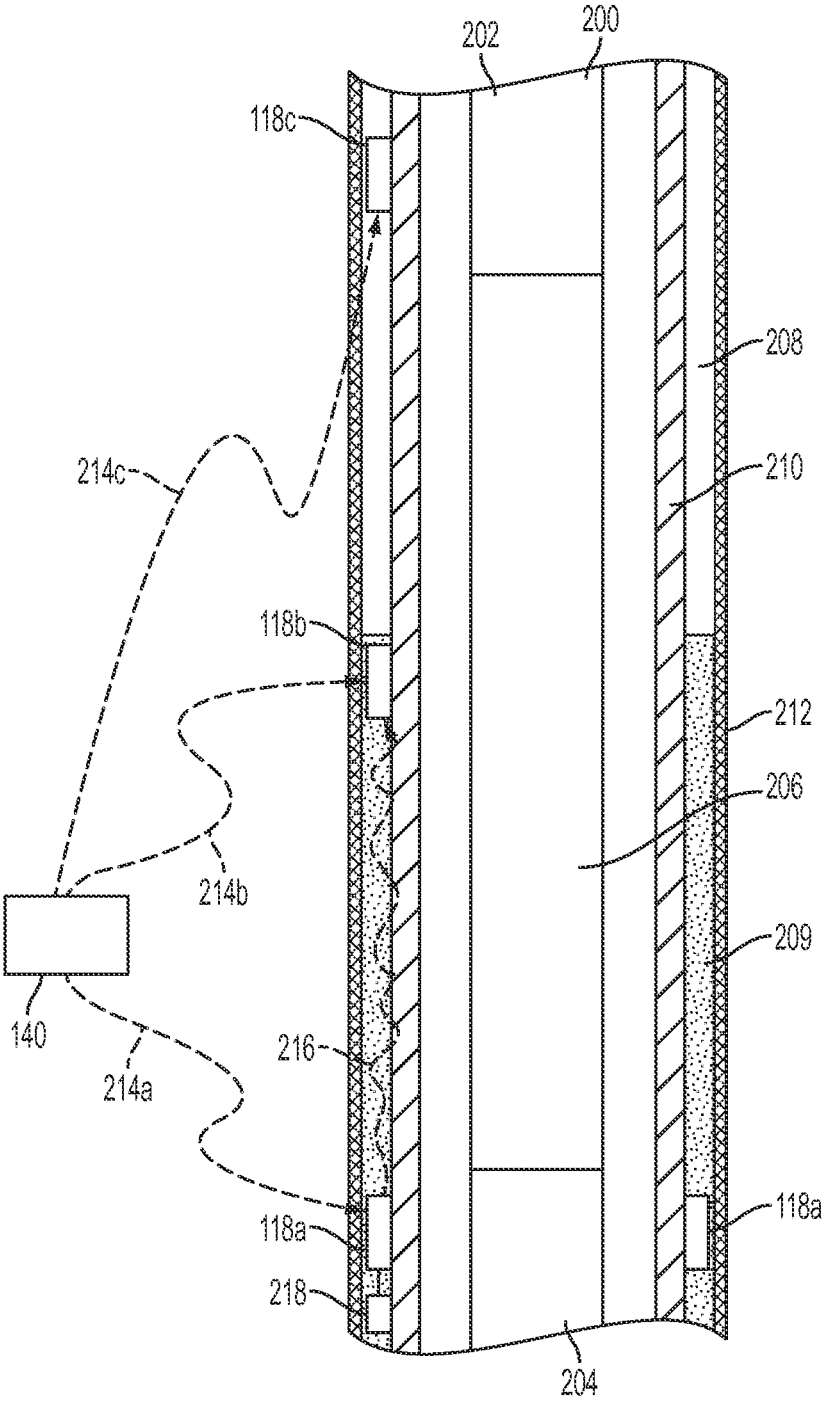
FIG. 2 is a cross-sectional side view of an example of part of a system for downhole communications using variable length data packets.

FIG. 2 is a cross-sectional side view of an example of part of a system for downhole communications using variable length data packets that includes transceivers 118*a-c*. The transceivers 118*a-c* can be positioned on or externally to a casing string 210 in a wellbore 220. For example, the transceiver 118*a* can be positioned coaxially around an outer housing of the casing string 210. In some examples, a well tool 200 can be positioned within the casing string 210. The well tool 200 can include three subsystems 202, 204, 206.

Fluid 209 (e.g., cement, mud, a spacing fluid, or a hydrocarbon) can be positioned in a space 208 between the casing string 210 to the subterranean formation 212. For example, a fluid 209 containing cement can be pumped into the space 208 during cementing operations. The fluid 209, however, may not fill the full longitudinal length of the space 208. This can generate an annulus between a portion of the casing string 210 and the subterranean formation 212.

In some examples, each transceiver 118*a* can include or be electrically coupled to a sensor 218. In the example shown in FIG. 2, the transceiver 118*a* is electrically coupled to the sensor 218 by a wire. Examples of the sensor 218 can include a pressure sensor, a temperature sensor, a microphone, an accelerometer, a depth sensor, a resistivity sensor, a vibration sensor, an ultrasonic transducer, a fluid analyzer or detector, and a RFID reader. In some examples, the sensor 218 can detect the presence of, absence of, or a characteristic of the fluid 209.

In some examples, the sensor 218 can transmit sensor signals to a processor (e.g., associated with a transceiver 118*a*). The sensor signals can be representative of sensor data. The processor can receive the sensor signals and cause the transceiver 118*a* to communicate the sensor data (e.g., to another transceiver 118*b*). For example, the processor can transmit signals to an antenna (e.g., a toroid antenna or a solenoid antenna) to generate wireless signals 216 representative of the sensor data. In some examples, the sensor 218 can additionally or alternatively transmit sensor signals to an electrical circuit. The electrical circuit can include operational amplifiers, integrated circuits, filters, frequency shifters, capacitors, an electrical-to-optical converter, inductors, and other electrical circuit components. The electrical circuit can receive the sensor signal and perform one or more functions (e.g., amplification, frequency shifting, filtering, conversion of electrical signals to optical pulses, analog-to-digital conversion, or digital-to-analog conversion) to cause the transceiver 118*a* to generate a wireless signal 216. For example, the electrical circuit can amplify and frequency-shift the sensor signals into a radio frequency (RF) range, and transmit the amplified and frequency-shifted signal to an antenna. This can cause the antenna to generate a RF communication that is representative of the sensor signals.

Figure 4:
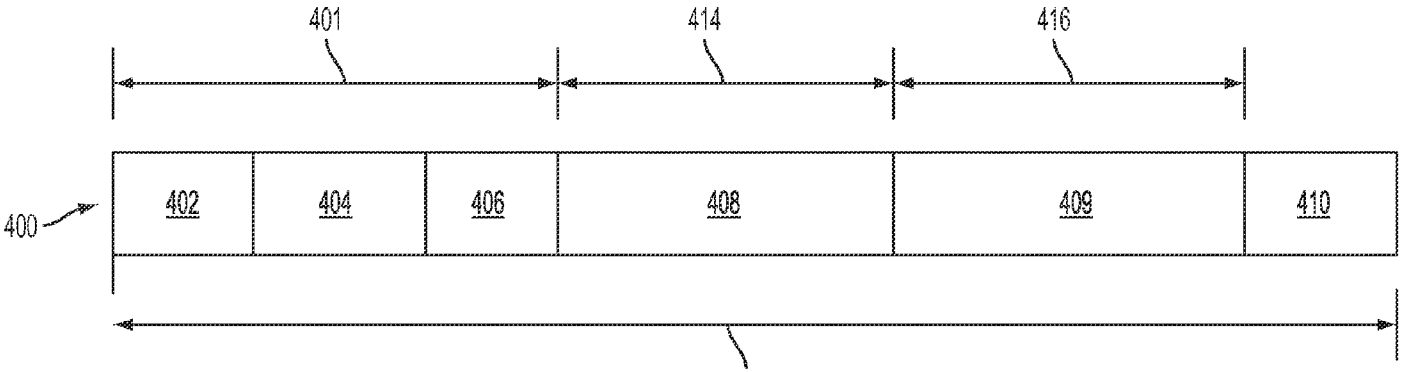
FIG. 4 is a block diagram of an example of another data packet with a length that is different than the length of the data packet shown in FIG. 3.
Figure 5:
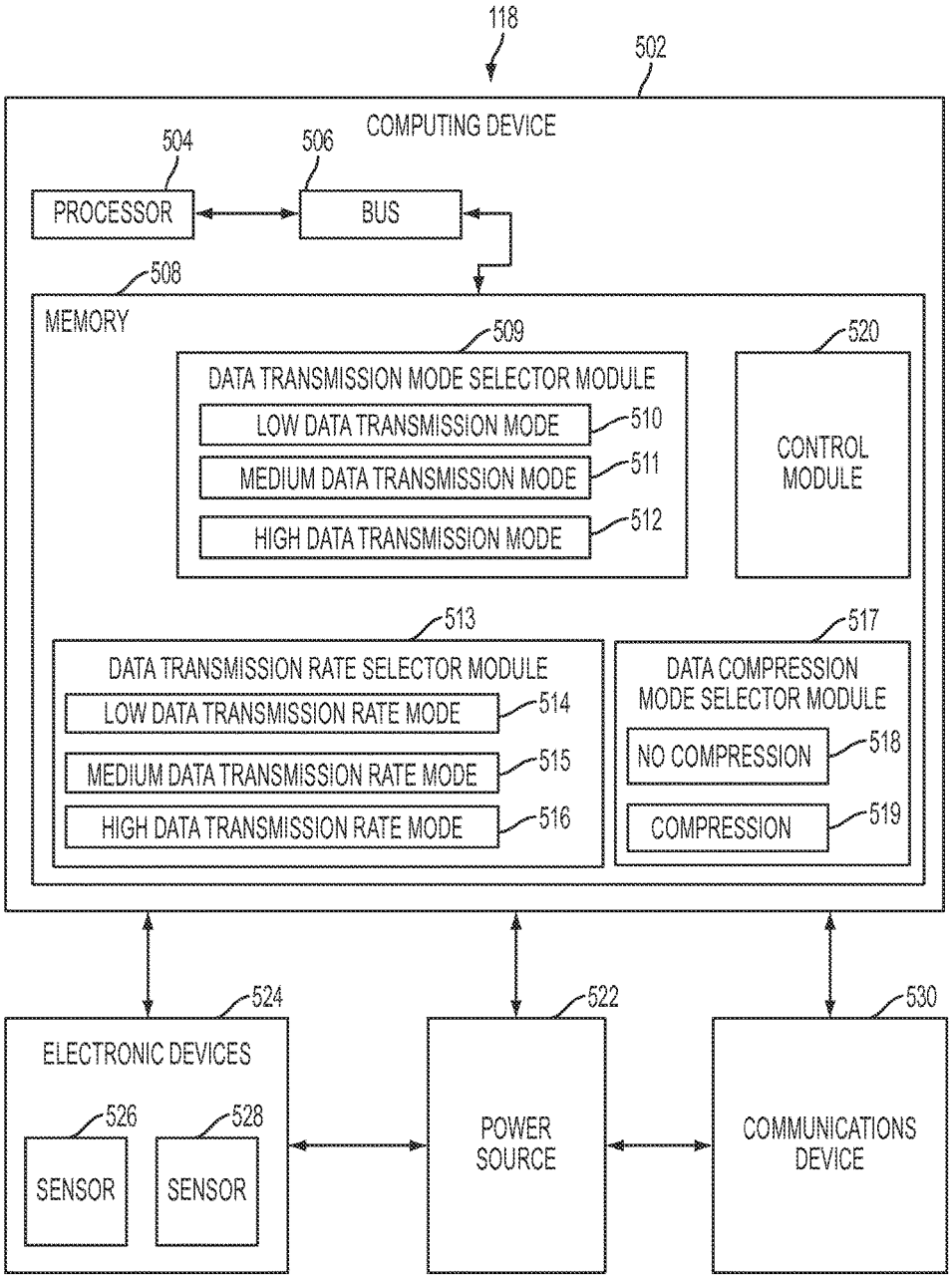
FIG. 5 is a block diagram of an example of a transceiver for implementing downhole communications using variable length data packets.

The transceivers 118*a-c* can be programmed to transmit any number of data packets having any particular length (e.g., described in greater detail with respect to FIGS. 4 and 5). In some examples, the transceivers 118*a-c* can be remotely programmed by the computing device 140 while positioned in the wellbore. For example, the computing device 140 can wirelessly transmit control signals 214*a-c* to the transceivers 118*a-c*. Each of the transceivers 118*a-c* can select a data transmission mode from among multiple available data transmission modes based on respective control signals 214*a-c*. Examples of the available data transmission modes can include a low data transmission mode, a medium data transmission mode, and a high data transmission mode. For example, the transceiver 118*a* can select high data transmission mode based on the control signal 214*a*. The transceivers 118*a-c* can have any number or configuration of data transmissions modes (e.g., the transceivers 118*a-c* can have 6 or more data transmission modes).

In some examples, the well operator may want to receive a limited amount of information about the well system. For example, the well operator can be interested in determining if the fluid 209 has passed by (or is near) a transceiver 118*a*. The well operator can transmit, via the computing device 140, the control signal 214*a* to the transceiver 118*a* to put the transceiver 118*a* in a first data transmission mode. In some examples, while in the first data transmission mode, the transceiver 118*a* can use the sensor 218 to detect whether the fluid 209 has passed the transceiver 118*a*. The transceiver 118*a* can wirelessly communicate a small amount of data (e.g., a binary 1 or 0) to the well operator (e.g., to the computing device 140) indicative of whether the fluid 209 has passed the transceiver 118*a*. By communicating a small amount of data, the transceiver 118*a* can save battery power while delivering the information of interest to the well operator.

In some examples, the well operator may want to receive a larger amount of information. For example, the well operator can be interested in determining if, and when, the fluid 209 has passed a transceiver 118*a*. The well operator can transmit, via the computing device 140, the control signal 214*a* to the transceiver 118*a* to put the transceiver 118*a* in a second data transmission mode. The transceiver 118*a* can communicate more data (e.g., via more data packets, longer data packets, or both) to the well operator when in the second data transmission mode than when in the first data transmission mode. In some examples, while in the second data transmission mode, the transceiver 118*a* can use the sensor 218 to detect the whether the fluid 209 passed the transceiver 118*a*. The transceiver 118*a* can wirelessly communicate to the well operator whether the fluid 209 passed the transceiver 118*a*, and a time of day in which the fluid 209 passed the transceiver 118*a*.

As another example, the well operator may want to receive an even larger amount of information. For example, the well operator can be interested in determining the types of fluids that have passed a transceiver 118*a*. The well operator can transmit, via the computing device 140, the control signal 214*a* to the transceiver 118*a* to place the transceiver 118*a* in a third data transmission mode. The transceiver 118*a* can communicate more data (e.g., via more data packets, longer data packets, or both) to the well operator when in the third data transmission mode than when in the second data transmission mode.

For example, while in the third data transmission mode, the transceiver 118*a* can use the sensor 218 to detect the characteristics of fluids passing the transceiver 118*a*. For example, the sensor 218 can include a RFID reader. Each fluid 209 in the well system can include a RFID tag with unique RFID number indicative of the fluid type. The transceiver 118*a* can read the RFID tags of the fluids 209 as the fluids 209 pass by the transceiver 118*a* to determine which fluids 209 have passed by the transceiver 118*a*. In another example, the sensor 218 can include two antennas. The antennas can be positioned so fluid 209 can flow between the antennas. The sensor 218 can transmit radio waves from one antenna to the other antenna and detect the characteristics of a received radio wave. Based on the characteristics of the received radio wave, the sensor 218 (or a processor in the transceiver 118*a*) can determine a dielectric profile of the fluid 209 between the antennas, which can be used to identify the fluid 209. For example, the transceiver 118*a* can compare the dielectric profile of the fluid 209 with known dielectric profiles using a lookup table. In some examples, the transceiver 118*a* can wirelessly communicate to the well operator which fluids have passed the transceiver 118*a*, and a time of day that each of the fluids passed the transceiver 118*a*.

Other examples of data that the transceivers 118*a-c* can communicate to a well operator can include a flow rate of a fluid 209, the presence of any anomalies in the fluid 209 or wellbore (e.g., if cement is the fluid, the presence of any anomalies as the cement sets), and the physical state of the fluid 209 (e.g., if the fluid changes to a solid physical state). For example, the fluid 209 can be cement, which can be pumped into the space 208 to couple the casing string 210 to the subterranean formation 212. It can be desirable to detect any anomalies present in cement as cement sets, because well components can be damaged and well operations can be hindered if the cement fails (e.g., cracks or de-bonds). The transceiver 118*a* can use the sensor 218 to detect the presence of anomalies (e.g., such as the presence of mud or air pockets within the cement) and transmit information about the anomalies to the well operator.

In some examples, the transceivers 118*a-c* can additionally or alternatively be programmed to use a particular data transmission rate. For example, the computing device 140 can transmit control signals 214*a-c* to each of the transceivers 118*a-c* to cause the transceivers 118*a-c* to select a data transmission rate from among multiple available data transmission rates. The data transmission rate can be the frequency at which the transceivers 118*a-c* transmit data to a receiver. In one example, the transceivers 118*a-c* can select a low data transmission rate, which can cause the transceivers 118*a-c* to transmit data once per minute. The transceivers 118*a-c* can select a medium data transmission rate, which can cause the transceivers 118*a-c* to transmit data once per second. The transceivers 118*a-c* can select a high data transmission rate, which can cause the transceivers 118*a-c* to transmit data once per millisecond. The transceivers 118*a-c* can select from among any number of data transmission rates with any configuration of time increments.

In some examples, the transceivers 118*a-c* can additionally or alternatively be programmed to use data compression. For example, the computing device 140 can transmit control signals 214*a-c* to the transceivers 118*a-c* to cause the transceivers 118*a-c* to select a data compression mode from among multiple available data compression modes. The data compression mode can configure the transceiver apply a particular method of data compression to the data, or to not compress the data, prior to transmitting the data. In one example, a data compression mode can cause the transceivers 118*a-c* to transmit data in an uncompressed form. Another data compression mode can cause the transceivers 118*a-c* to transmit data in a compressed form. Still another data compression mode can cause the transceivers 118*a-c* to transmit data in another compressed form. The data compression modes can allow the well operator to control the quality of the data transmitted by the transceivers 118*a-c*.

Figure 3:
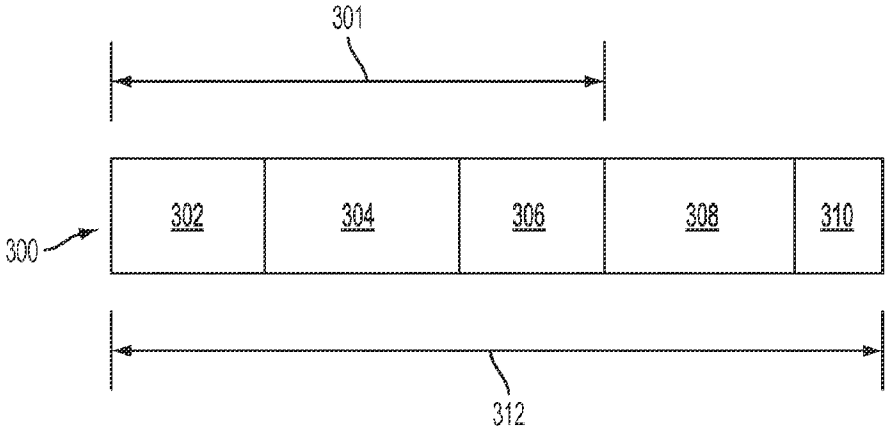
FIG. 3 is a block diagram of an example of a data packet with a particular length.

FIG. 3 is a block diagram of an example of a data packet 300 with a particular length 312. In some examples, the data packet 300 can include a header 301. The header 301 can includes multiple data frames 302, 304, 306. Each frame 302, 304, 306 can include a string of bits representing information about the data packet 300. For example, the frame 302 can include a packet identifier or number. The frame 304 can include a transmission protocol (e.g., IEEE 802.11g). The frame 306 can include timing and synchronization information. In some examples, the header 301 can include other information, such as a destination address, a source address, an error detection code, and a length 312 of the data packet 300.

In some examples, the data packet 300 can include a payload 308. The payload 308 can have a variable length. In the example shown in FIG. 3, the payload 308 contains a single frame of data. In other examples (e.g., the example shown in FIG. 4), the payload 308 can include multiple frames of data. The payload 308 can include a string of bits representative of data from one or more sensors associated with a transceiver. For example, the payload 308 can include a string of bits associated with a type of a fluid in a wellbore, a RFID number, a time in which a fluid passed a particular location in the wellbore, or any combination of these.

In some examples, the data packet 300 can include a footer 310. The footer 310 can include a string of bits indicative of the end of the data packet 300. In some examples, the footer 310 includes data usable for error checking (e.g., for performing a cyclic redundancy check). The data packet 300 can additionally or alternatively include other data and arrangements of data.

FIG. 4 is a block diagram of an example of another data packet 400 with a length 412 that is different than the length 312 of the data packet 300 shown in FIG. 3. The data packet 400 can include a header 401 with various frames 402, 404, 406 of information. The data packet 400 can also include multiple payload frames 408, 409. Each of the payload frames 408, 409 can have a variable length 414, 416. In some examples, a payload frame 408 can have a length 414 that is longer than the length of the payload 308 of FIG. 3. The data packet 400 can also include a footer 410, which can be substantially the same as the footer 310 of FIG. 3.

FIG. 5 is a block diagram of an example of a transceiver 118 for implementing downhole communications using variable length data packets. In some examples, the components shown in FIG. 5 (e.g., the computing device 502, power source 522, electronic devices 524, and communications device 530) can be integrated into a single structure. For example, the components can be within a single housing. In other examples, the components shown in FIG. 5 can be distributed (e.g., in separate housings) and in electrical communication with each other.

The transceiver 118 can include a computing device 502. The computing device 502 can include a processor 504, a memory 508, and a bus 506. The processor 504 can execute one or more operations for operating the transceiver 118. The processor 504 can execute instructions stored in the memory 508 to perform the operations. The processor 504 can include one processing device or multiple processing devices. Non-limiting examples of the processor 504 include a Field-Programmable Gate Array ("FPGA"), an application-specific integrated circuit ("ASIC"), a microprocessor, etc.

The processor 504 can be communicatively coupled to the memory 508 via the bus 506. The non-volatile memory 508 may include any type of memory device that retains stored information when powered off. Non-limiting examples of the memory 508 include electrically erasable and programmable read-only memory ("EEPROM"), flash memory, or any other type of non-volatile memory. In some examples, at least some of the memory 508 can include a medium from which the processor 504 can read the instructions. A computer-readable medium can include electronic, optical, magnetic, or other storage devices capable of providing the processor 504 with computer-readable instructions or other program code. Non-limiting examples of a computer-readable medium include (but are not limited to) magnetic disk(s), memory chip(s), ROM, random-access memory ("RAM"), an ASIC, a configured processor, optical storage, or any other medium from which a computer processor can read instructions. The instructions can include processor-specific instructions generated by a compiler or an interpreter from code written in any suitable computer-programming language, including, for example, C, C++, C#, etc.

The memory 508 can include various modules 509, 513, 517, 520 for enabling downhole communications using variable length packets. In some examples, the memory 508 can include a data transmission mode selector module 509. The data transmission mode selector module 509 can include instructions for selecting among multiple data transmission modes to use to transmit data. For example, the data transmission mode selector module 509 can include instructions for selecting among a low data transmission mode 510, a medium data transmission mode 511, and a high data transmission mode 512. The different data transmission modes 510-512 can cause the transceiver 118 to output different numbers of data packets, different length data packets, or both when wirelessly communicating.

In some examples, the memory 508 can include a data transmission rate selector module 513. The data transmission rate selector module 513 can include instructions for selecting among multiple data transmission rates to use to transmit data. For example, the data transmission rate selector module 513 can include instructions for selecting among a low data transmission rate mode 514, a medium data transmission rate mode 515, and a high data transmission rate mode 516.

In some examples, the memory 508 can include a data compression mode selector module 517. The data compression mode selector module 517 can include instructions for selecting among multiple data compression modes. For example, the data compression mode selector module 517 can include instructions for selecting among a no compression mode 518 and a compression mode 519.

In some examples, the memory 508 can include a control module 520. The control module 520 can include instructions for receiving a control signal (e.g., from a computing device positioned at the well surface) or indicia of a user input (e.g., if the user programs the transceiver 118 prior to positioning the transceiver 118 in the wellbore). The control module 520 can include instructions for operating the data transmission mode selector module 509, data transmission rate selector module 513, and data compression mode selector module 517 based on the control signal or user input. For example, the control module 520 can cause the data transmission mode selector module 509 to select a low data transmission mode 510 based on the control signal.

In some examples, the control module 520 can include instructions for receiving a wireless communication from another transceiver 118. The control module 520 can include instructions for operating the data transmission mode selector module 509, data transmission rate selector module 513, and data compression mode selector module 517 based on the amount of data in the wireless communication. For example, the control module 520 can include instructions for determining, based on the amount of data in the wireless communication, that the transceiver 118 need not transmit as much data (e.g., because the data may be duplicative, unhelpful, or otherwise superfluous) or that the transceiver 118 should transmit more data (e.g., because the data sent from the other transceiver was incomplete or insufficient). The control module 520 can including instructions for operating the data transmission mode selector module 509, the data transmission rate selector module 513, and the data compression mode selector module 517 to vary the amount of data sent by the transceiver 118 (e.g., to select a new data transmission mode, a new data transmission rate, and a new data compression mode configured).

The transceiver 118 can include the power source 522. The power source 522 can be in electrical communication with the computing device 502, the communications device 530, and the electronic devices 524. In some examples, the power source 522 can include a battery (e.g., for powering the transceiver 118). In other examples, the transceiver 118 can be coupled to and powered by an electrical cable (e.g., a wireline). Additionally or alternatively, the power source 522 can include an AC signal generator. The computing device 502 can operate the power source 522 to apply a transmission signal to the communications device 530. For example, the computing device 502 can cause the power source 522 to apply a voltage with a frequency to the communications device 530 for generating a wireless transmission.

The communications device 530 can include or can be coupled to an antenna. In some examples, part of the communications device 530 can be implemented in software. For example, part of the communications device 530 can include instructions stored in memory 508. In some examples, the communications device 530 can be substantially the same as the communication device 142 of FIG. 1.

The communications device 530 can detect wireless signals (e.g., from another transceiver 118 or a computing device) via an antenna. In some examples, the communications device 530 can amplify, filter, demodulate, frequency shift, and otherwise manipulate the detected signals. The communications device 530 can transmit a signal associated with the detected signals to the processor 504. In some examples, the processor 504 can receive and analyze the signal to retrieve data associated with the detected signals.

In some examples, the processor 504 can analyze the data and perform one or more functions. For example, the data can be from a control signal and can be indicative of a particular data transmission mode. The processor 504 can receive the data and use the data transmission mode selector module 509 (or the control module 520) to select the particular data transmission mode. As another example, the data can be from a control signal and indicative of a particular data transmission rate mode. The processor 504 can receive the data and use the data transmission rate selector module 513 (or the control module 520) to select a particular data transmission rate.

In some examples, the communications device 530 can receive signals (e.g., associated with data to be transmitted) from the processor 504 and amplify, filter, modulate, frequency shift, and otherwise manipulate the signals. The communications device 530 can transmit the manipulated signals to an antenna to generate wireless signals representative of the data.

The transceiver 118 can include electronic devices 524. The electronic devices 524 can include one or more sensors 526, 528. Examples of the sensors 526, 528 can include pressure sensors, temperature sensors, microphones, accelerometers, depth sensors, resistivity sensors, vibration sensors, ultrasonic transducers, fluid analyzers or sensors, and RFID readers. The sensors 526, 528 can transmit data to the processor 504 (e.g., for analysis or communication to other transceivers 118).

In some examples, the processor 504 can activate, deactivate, or otherwise operate any number of electronic devices 524. For example, the processor 504 can operate the electronic devices 524 based on the data transmission mode. In one example, if the transceiver 118 is in a low data transmission mode 510, the processor 504 can deactivate the sensor 526. This can prevent the processor 504 from receiving data from the sensor 526. The processor 504 may still be able to receive data from the sensor 528. By controlling (e.g., turning on or off) the electronic devices 524 based on the data transmission mode, the transceiver 118 can limit the amount of battery power that is used. For example, if the transceiver 118 is in a data transmission mode that renders data from the sensor 528 superfluous (e.g., the data from the sensor 528 can be unusable or have little value given the amount of data to be transmitted in the particular data transmission mode), the processor 504 can deactivate (e.g., turn off) the sensor 528. This can prevent the sensor 528 from drawing battery power.

Figure 6:
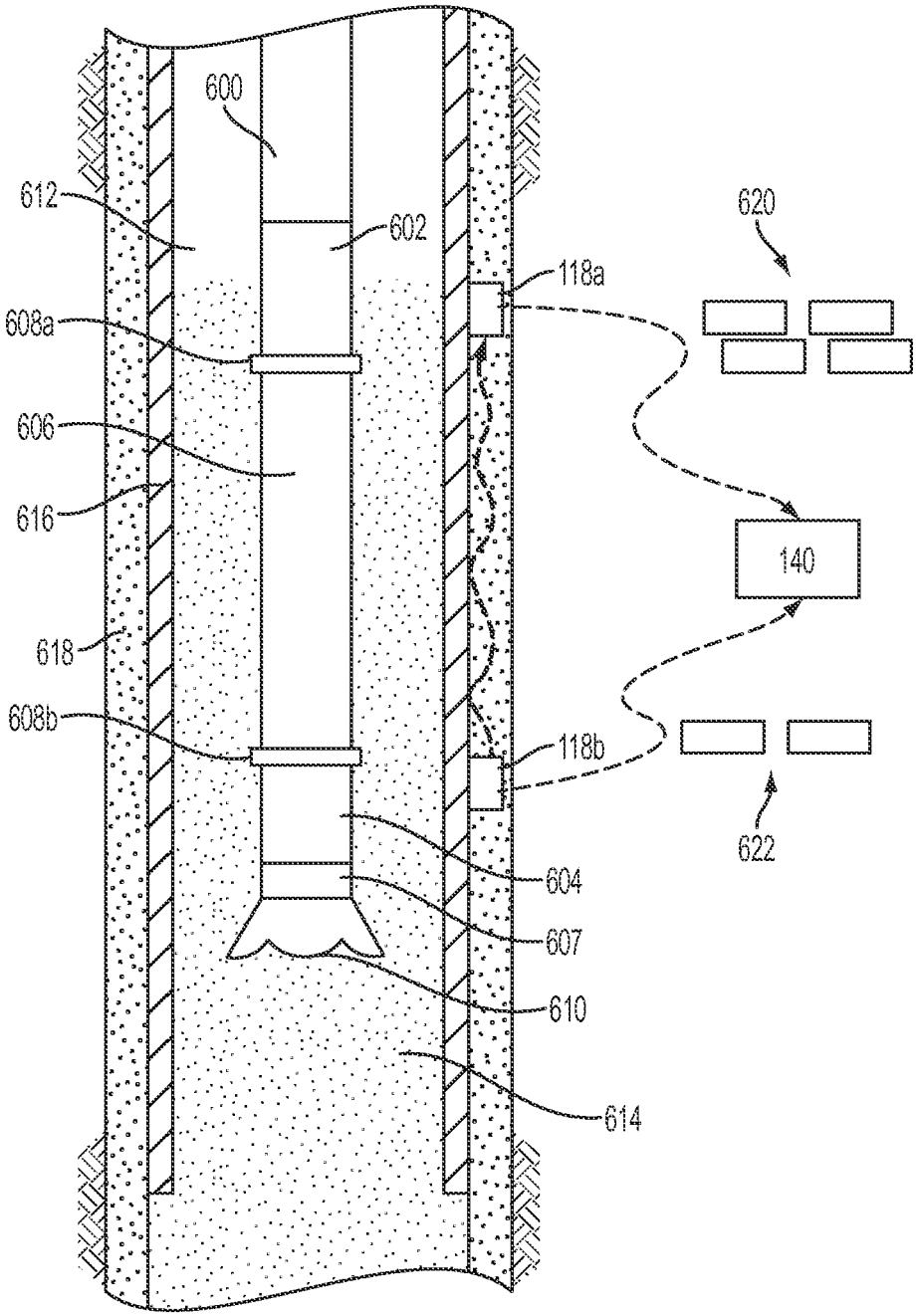
FIG. 6 is a cross-sectional side view of another example of part of a system for downhole communications using variable length data packets.

FIG. 6 is a cross-sectional side view of another example of part of a system for downhole communications using variable length data packets. In this example, the well system includes a wellbore. The wellbore can include a casing string 616 and a cement sheath 618. The wellbore can include a fluid 614. The fluid 614 (e.g., mud) can flow in an annulus 612 positioned between the well tool 600 and a wall of the casing string 616.

A well tool 600 (e.g., logging-while-drilling tool) can be positioned in the wellbore. The well tool 600 can include various subsystems 602, 604, 606, 607. For example, the well tool 600 can include a subsystem 602 that includes a communication subsystem. The well tool 600 can also include a subsystem 604 that includes a saver subsystem or a rotary steerable system. A tubular section or an intermediate subsystem 606 (e.g., a mud motor or measuring-while-drilling module) can be positioned between the other subsystems 602, 604. In some examples, the well tool 600 can include a drill bit 610 for drilling the wellbore. The drill bit 610 can be coupled to another tubular section or intermediate subsystem 607 (e.g., a measuring-while-drilling module or a rotary steerable system).

The well tool 600 can also include tubular joints 608*a*, 608*b*. Tubular joint 608*a* can prevent a wire from passing between one subsystem 602 and the intermediate subsystem 606. Tubular joint 608*b* can prevent a wire from passing between the other subsystem 604 and the intermediate subsystem 606. The tubular joints 608*a*, 608*b* may make it challenging to communicate data through the well tool 600. It may be desirable to communicate data externally to the well tool 600, for example, using transceivers 118*a-b*.

The transceivers 118*a-b* can be positioned external to the casing string 616. The transceivers 118*a-b* can wirelessly communicate data using any number of data packets and any length data packets. For example, the transceiver 118*a* can transmit four data packets 620 to a computing device 140 during a particular wireless communication. The transceiver 118*b* can transmit two data packets 622 to the computing device 140 during a particular wireless communication. Each of the transceivers 118*a-b* can be individually programmed (e.g., via control signals) to operate in a particular data transmission mode (e.g., to transmit a particular number of data packets 620, 622 or amount of data) that can be the same as or different from one another.

Figure 7:
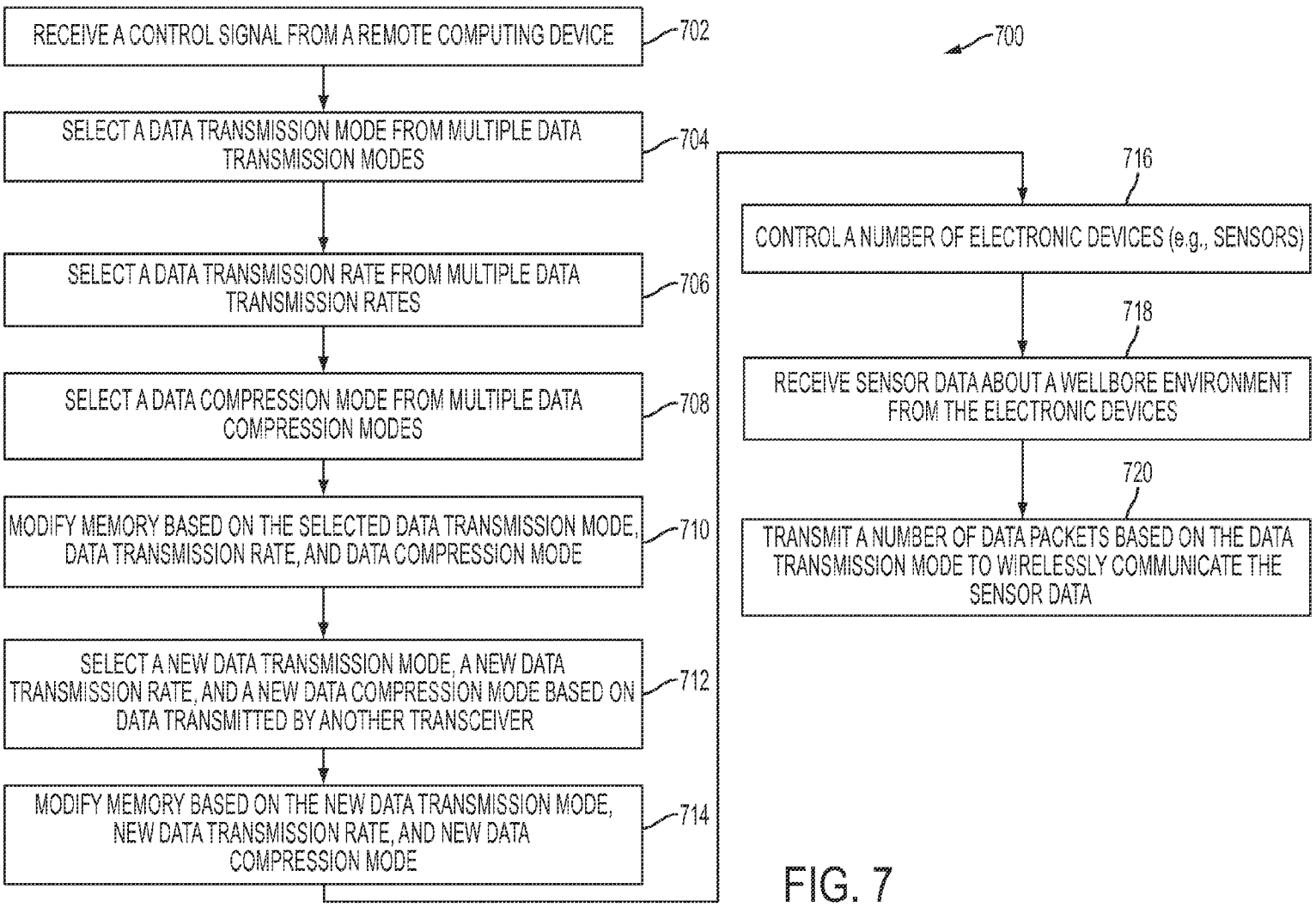
FIG. 7 is a flow chart showing an example of a process for downhole communications using variable length data packets according to one example.

FIG. 7 is a flow chart showing an example of a process 700 for downhole communications using variable length data packets according to one example.

In block 702, a transceiver can receive a control signal from a remote computing device. The remote computing device can be positioned in a wellbore, at a surface of the wellbore, or elsewhere in a well system. The control signal can include data that can be interpreted by the transceiver. The transceiver can perform one or more functions (e.g., selecting a data transmission mode) based on the data.

In block 704, the transceiver can select a data transmission mode from among multiple data transmission modes. For example, the transceiver can select a data transmission mode based on the control signal or based on user input. In some examples, the data transmission modes can include a low data transmission mode, a medium data transmission mode, and a high data transmission mode.

In block 706, the transceiver can select a data transmission rate from among multiple data transmission rates. For example, the transceiver can select a data transmission rate based on the control signal or based on user input. In some examples, the data transmission rates can include a low data transmission rate, a medium data transmission rate, and a high data transmission rate.

In block 708, the transceiver can select a data compression mode from among multiple data compression modes. For example, the transceiver can select a data transmission mode based on the control signal or based on user input. In some examples, the data transmission modes can include no data compression, data compression using one compression algorithm, and data compression using another compression algorithm.

In block 710, the transceiver (e.g., a processor) modifies memory based on the selected data transmission mode, data transmission rate, and data compression mode. For example, the transceiver can use a data transmission mode selector module in memory to set a memory location to a particular value for setting the data transmission mode. The transceiver can use a data transmission rate selector module in memory to set a memory location to a particular value for setting the data transmission rate. The transceiver can use a data compression mode selector module in memory to set a memory location to a particular value for setting the data compression mode. In this manner, the transceiver can store the data transmission mode, data transmission rate, and data compression mode selections.

In block 712, the transceiver can select a new data transmission mode, a new data transmission rate, and a new data compression mode based on data transmitted by another transceiver. For example, the transceiver can receive a wireless communication sent from another transceiver. The wireless communication can include an amount of data. The transceiver can determine, based on the amount of data in the wireless communication, that it need not transmit as much data. The transceiver can select a new data transmission mode, a new data transmission rate, and a new data compression mode. In some examples, the selections from the control signal can override the transceiver's data transmission mode, data transmission rate, and data compression mode selections. In other examples, the transceiver's data transmission mode, data transmission rate, and data compression mode selections can override the selections from the control signal.

In block 714, the transceiver (e.g., a processor) modifies memory based on the new data transmission mode, new data transmission rate, and new data compression mode. Similar to block 710, the transceiver can use a data transmission mode selector module in memory to set a memory location to a particular value for setting the new data transmission mode. The transceiver can use a data transmission rate selector module in memory to set a memory location to a particular value for setting the new data transmission rate. The transceiver can use a data compression mode selector module in memory to set a memory location to a particular value for setting the new data compression mode. In this manner, the transceiver can store the new data transmission mode, data transmission rate, and data compression mode selections.

In block 716, the transceiver can control a number of electronic devices (e.g., sensors). The transceiver can control a number of electronic devices based on the data transmission mode, the data transmission rate, and the data compression mode. In some examples, if the transceiver is in a low data transmission mode, the transceiver can activate a subset of a total number of electronic devices. For example, the transceiver can activate two out of five total electronic devices. This can allow the transceiver to turn off electronic devices that would communicate superfluous data and unnecessarily drain battery power. As another example, if the transceiver is in a high data transmission mode, the transceiver can activate all of the electronic devices (e.g., all five electronic devices).

In block 718, the transceiver can receive sensor data about a wellbore environment from the electronic devices. For example, the electronic devices can include sensors. The sensors can include a pressure sensor, a temperature sensor, a microphone, an accelerometer, a depth sensor, a resistivity sensor, a vibration sensor, an ultrasonic transducer, a fluid analyzer or detector, and a RFID reader. The sensors can detect a temperature, a pressure, and a sound level within the wellbore; the presence or absence of a fluid (e.g., mud, a hydrocarbon, spacer fluid, or cement) at a particular location in the wellbore; a type of a fluid in the wellbore (e.g., whether the fluid includes a hydrocarbon, mud, cement, water, spacer fluid, or any combination of these); and a physical state (e.g., solid, liquid, gas, or plasma) of a substance (e.g., cement) in the wellbore. The sensors can transmit the sensor data to a processor (e.g., within the transceiver).

In block 720, the transceiver can transmit a number of data packets based on the data transmission mode to wirelessly communicate the sensor data. The number of packets can additionally or alternatively be based on the data transmission rate and the data compression mode. For example, if the transceiver is in a low data transmission mode, the transceiver can transmit five kilobytes of information to wirelessly communicate the sensor data. The five kilobytes of data can be broken up evenly or unevenly among the number of data packets. If the transceiver is in a high data transmission mode, the transceiver can transmit a five megabytes of information to wirelessly communicate the sensor data. The five megabytes of data can be broken up evenly or unevenly among the number of data packets.

In some aspects, systems and methods for downhole communications using variable length data packets are provided according to one or more of the following examples:

Example #1

A system that is positionable in a wellbore can include a transceiver. The transceiver can be positionable external to a casing string. The transceiver can be programmable to vary a number of data packets that are wirelessly transmitted by the transceiver. The number of data packets can correspond to an amount of data wirelessly transmitted by the transceiver about an environment in the wellbore.

Example #2

The system of Example #1 may feature the transceiver being remotely programmable subsequent to the transceiver being positioned in the wellbore.

Example #3

The system of any of Examples #1-2 may feature a computing device positionable at a surface of the wellbore and operable to remotely program the transceiver by wirelessly transmitting a control signal to the transceiver.

Example #4

The system of any of Examples #1-3 may feature the transceiver including a processing device and a memory device. The memory device can store instructions executable by the processing device for causing the processing device to: receive a control signal; and select, based on the control signal, a transmission mode from among at least three different transmission modes. The at least three different transmission modes can include a low data mode, a medium data mode, and a high data mode.

Example #5

The system of any of Examples #1-4 may feature a memory device that stores instructions executable by a processing device for causing the processing device to: control a first subset of a total amount of electrical devices when the transceiver is in the low data mode; and control a second subset of the total amount of electrical devices when the transceiver is in the medium data mode. The first subset can be less than the second subset.

Example #6

The system of any of Examples #1-5 may feature a memory device that stores instructions executable by a processing device for causing the processing device to: receive a wireless transmission from another transceiver; determine a second amount of data associated with the wireless transmission; and modify a transmission mode based on the second amount of data.

Example #7

The system of any of Examples #1-6 may feature a sensor that includes a Radio Frequency Identification (RFID) reader or a fluid analyzer. The transceiver can be coupled to the sensor for acquiring data about the environment in the wellbore.

Example #8

A communication system that is positionable in a wellbore can include a first transceiver that is positionable external to a casing string. The first transceiver can be programmable to vary a number of data packets that are wirelessly transmitted by the first transceiver. The number of data packets can correspond to a first amount of data wirelessly transmitted by the first transceiver about an environment in the wellbore. The communication system can also include a second transceiver that is positionable external to the casing string. The second transceiver can be for receiving the first amount of data wirelessly transmitted by the first transceiver and transmitting a second amount of data to a third transceiver.

Example #9

The communication system of Example #8 may feature the first transceiver and the second transceiver being remotely programmable subsequent to the first transceiver and the second transceiver being positioned in the wellbore.

Example #10

The communication system of any of Examples #8-9 may feature a computing device positionable at a surface of the wellbore. The computing device can be operable to remotely program the first transceiver and the second transceiver by wirelessly transmitting a control signal to the first transceiver and the second transceiver.

Example #11

The communication system of any of Examples #8-10 may feature first transceiver including a processing device and a memory device. The memory device can store instructions executable by the processing device for causing the processing device to: receive the control signal; and select, based on the control signal, a transmission mode from among at least three different transmission modes. The at least three different transmission modes can include a low data mode, a medium data mode, and a high data mode.

Example #12

The communication system of any of Examples #8-11 may feature a memory device that stores instructions executable by a processing device for causing the processing device to: control a first subset of a total amount of electrical devices when the first transceiver is in the low data mode; and control a second subset of the total amount of electrical devices when the first transceiver is in the medium data mode. The first subset can be less than the second subset.

Example #13

The communication system of any of Examples #8-12 may feature a processing device and a memory device. The memory device can store instructions executable by the processing device for causing the processing device to: receive the first amount of data from the first transceiver; and determine the second amount of data based on the first amount of data. The second amount of data can be different than the first amount of data.

Example #14

The communication system of any of Examples #8-13 may feature the third transceiver being positioned at a well surface.

Example #15

The communication system of any of Examples #8-14 may feature a sensor that includes a Radio Frequency Identification (RFID) reader or a fluid analyzer. The first transceiver can be coupled to the sensor for acquiring the first amount of data.

Example #16

A method can include receiving, by a programmable transceiver that is external to a casing string, a control signal from a remotely located computing device. The method can also include selecting, based on the control signal, a transmission mode from a plurality of transmission modes. The transmission mode can determine a number of data packets corresponding to an amount of data to be wirelessly transmitted by the programmable transceiver. The method can further include modifying a memory device in the programmable transceiver based on a selected transmission mode. The method can also include wirelessly transmitting the number of data packets. The data carried by the number of data packets can be about an environment in a wellbore.

Example #17

The method of Example #16 may feature receiving, from a sensor, the data about the environment in the wellbore. The data can include a Radio Frequency Identification (RFID) number or a characteristic of a fluid.

Example #18

The method of any of Examples #16-17 may feature controlling, by the programmable transceiver, a subset of a total number of electronic devices based on the transmission mode.

Example #19

The method of any of Examples #16-18 may feature receiving a wireless transmission from a transceiver. The method may also feature determining a second amount of data associated with the wireless transmission. The method may further feature modifying the transmission mode based on the second amount of data.

Example #20

The method of any of Examples #16-19 may feature the control signal being a wireless control signal and the remotely located computing device being positioned at a surface of the wellbore.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system that is positionable in a wellbore, the system comprising:

a transceiver that is positionable external to a casing string and programmable to vary how many data packets are to be wirelessly transmitted by the transceiver for communicating an amount of data about an environment in the wellbore, wherein the transceiver comprises:

a processing device; and a memory device in which instructions executable by the processing device are stored for causing the processing device to:

receive a control signal from a computing device that is remote from the transceiver;

select, based on the control signal, a transmission mode from among at least three different transmission modes comprising a low data mode, a medium data mode, and a high data mode;

select, based on the control signal, a data transmission rate from among a plurality of data transmission rates, wherein the data transmission rate is selected separately from the transmission mode; and wirelessly transmit the data packets to another transceiver in accordance with the selected transmission mode and the selected data transmission rate.

2. The system of claim 1, wherein the transceiver is remotely programmable subsequent to the transceiver being positioned in the wellbore.

3. The system of claim 2, further comprising the computing device positioned at a surface of the wellbore and operable to remotely program the transceiver by wirelessly transmitting the control signal to the transceiver.

4. The system of claim 1, wherein the transceiver is configured to vary a payload length of the data packets based on the selected transmission mode.

5. The system of claim 1, wherein the memory device further comprises instructions executable by the processing device for causing the processing device to:

control a first subset of a total amount of electrical devices when the transceiver is in the low data mode; and control a second subset of the total amount of electrical devices when the transceiver is in the medium data mode, the first subset being less than the second subset.

6. The system of claim 1, wherein the amount of data is a first amount of data, and wherein the memory device further comprises instructions executable by the processing device for causing the processing device to:

receive a wireless transmission from another transceiver;

determine a second amount of data associated with the wireless transmission; and modify the transmission mode based on the second amount of data.

7. The system of claim 1, further comprising a sensor that includes a Radio Frequency Identification (RFID) reader or a fluid analyzer, wherein the transceiver is coupled to the sensor for acquiring data about the environment in the wellbore.

8. The system of claim 1, wherein the data transmission rate controls a frequency at which a group of data packets is to be wirelessly transmitted, and the transmission mode controls how many data packets are to be included in the group of data packets each time the group of data packets is wirelessly transmitted.

9. The system of claim 8, wherein the memory device further includes instructions executable by the processing device for causing the processing device to:

select a compression mode from among a plurality of compression modes based on the control signal, wherein the compression mode is selected separately from the transmission mode and the data transmission rate, and wherein the compression mode controls whether or not data compression is to be applied to the data included in the group of data packets.

10. The system of claim 1, wherein the control signal specifies the transmission mode.

11. A communication system comprising:

a computing device; and a transceiver that is remote from the computing device and positionable external to a casing string, wherein the transceiver comprises:

a processing device; and a memory device in which instructions executable by the processing device are stored for causing the processing device to:

receive a control signal from the computing device that is remote from the transceiver;

select, based on the control signal, a transmission mode from among at least three different transmission modes comprising a low data mode, a medium data mode, and a high data mode;

select, based on the control signal, a data transmission rate from among a plurality of data transmission rates, wherein the data transmission rate is selected separately from the transmission mode; and wirelessly transmit data packets to another transceiver in accordance with the selected transmission mode and the selected data transmission rate, wherein data carried by the data packets is about an environment in a wellbore.

12. The communication system of claim 11, wherein the memory device further comprises instructions executable by the processing device for causing the processing device to:

control a first subset of a total amount of electrical devices when the transceiver is in the low data mode; and control a second subset of the total amount of electrical devices when the transceiver is in the medium data mode, the first subset being less than the second subset.

13. The communication system of claim 11, wherein the memory device further comprises instructions executable by the processing device for causing the processing device to:

receive a wireless transmission from another transceiver;

determine an amount of data associated with the wireless transmission; and modify the transmission mode based on the amount of data.

14. The communication system of claim 11, wherein the computing device is positioned at a well surface.

15. The communication system of claim 11, further comprising a sensor that includes a Radio Frequency Identification (RFID) reader or a fluid analyzer, wherein the transceiver is coupled to the sensor for acquiring data about an environment in a wellbore.

16. The communication system of claim 11, wherein the transceiver is remotely programmable subsequent to the transceiver being positioned in a wellbore.

17. The communication system of claim 16, wherein the computing device is operable to remotely program the transceiver by wirelessly transmitting the control signal to the transceiver.

18. A method comprising:

receiving, by a programmable transceiver that is positionable external to a casing string, a control signal from a remotely located computing device;

selecting, by the programmable transceiver and based on the control signal, a transmission mode from at least three different transmission modes comprising a low data mode, a medium data mode, and a high data mode;

selecting, by the programmable transceiver, a data transmission rate from among a plurality of data transmission rates based on the control signal, wherein the data transmission rate is selected separately from the transmission mode; and wirelessly transmitting, by the programmable transceiver, data packets to another transceiver in accordance with the selected transmission mode and the selected data transmission rate, wherein data carried by the data packets is about an environment in a wellbore.

19. The method of claim 18, further comprising:

receiving a wireless transmission from a transceiver;

determining an amount of data associated with the wireless transmission; and modifying the transmission mode based on the amount of data.

20. The method of claim 18, wherein the control signal is a wireless control signal and the remotely located computing device is positioned at a surface of the wellbore.

21. The method of claim 18, further comprising:

receiving, from a sensor, the data about the environment in the wellbore, wherein the data comprises a Radio Frequency Identification (RFID) number or a characteristic of a fluid.

22. The method of claim 18, further comprising:

controlling, by the programmable transceiver, a subset of a total number of electronic devices based on the transmission mode.

* * * * *